United States Patent [19]

Schnebly

[11] 4,023,845

[45] May 17, 1977

[54] VACUUM LIFTER

[75] Inventor: Fred H. Schnebly, Lakewood, Calif.

[73] Assignee: Northrop Corporation, Los Angeles, Calif.

[22] Filed: Sept. 5, 1975

[21] Appl. No.: 610,879

[52] U.S. Cl. ..... 294/64 R

[51] Int. Cl.[2] ..... B66C 1/02

[58] Field of Search ..... 294/64 R, 65; 214/650 SG; 248/362, 363; 269/21; 279/3

[56] References Cited

UNITED STATES PATENTS

| | | | |
|---|---|---|---|
| 3,307,869 | 3/1967 | Warfel | 294/64 R |
| 3,627,369 | 12/1971 | Nixon | 294/64 R |
| 3,863,969 | 2/1975 | Weiss et al. | 294/64 R |
| 3,910,620 | 10/1975 | Sperry | 294/64 R |

*Primary Examiner*—Johnny D. Cherry

*Attorney, Agent, or Firm*—Willard M. Graham; William W. Rundle

[57] ABSTRACT

A vacuum lifter in the form of a pair of saucer-shaped clamps securing between them a segmented, resilient, thin metal sealing ring surrounding a vacuum chamber defined in the underside of the lifter. The clamping surfaces of the lifter are angularly disposed in such a way that the sealing ring engages the surface of a part to be lifted at a shallow angle. Suction is applied to the underside of the lifter creating a vacuum which draws the sealing ring segments together into substantially airtight formation around the lifter vacuum chamber sealing the underside of the lifter from atmosphere and causing the lifter to adhere to the surface engaged thereby while the part is lifted and conveyed from one location to another.

2 Claims, 4 Drawing Figures

VACUUM LIFTER

BACKGROUND

My invention relates to vacuum lifters of the general type disclosed for example in U.S. Pat. Nos. 1,426,930 (Waldron), 3,154,306 (Elliott et al.), and more particularly to U.S. Pat. No. 3,863,969 (Weiss et al.).

Previously known vacuum lifters employ a flexible cup formed of rubber or a rubber-containing composition to engage the surface of a load to be lifted. Suction is applied to the hollow interior of the cup in the conventional manner to adhere the lip or rim of the cup to the load surface by vacuum so that the load can be lifted and transported from one location to another. However, rubber and compositions or material containing rubber are not suitable for handling metal sheets or parts that are heated to high temperatures, for example sheet metal parts that are heat-treated or hot-formed in furnaces or ovens.

To overcome the inability of rubber or rubber-like materials to withstand high temperatures, Weiss et al. (No. 3,863,969), cited above, propose to employ, in a vacuum lifter, a sealing ring made of rubber-bonded asbestos fibers, which ring engages the surface of hot sheet metal, as described under "Example", Columns 4 and 5. By means of the sealing ring, and the use of certain specified lubricants in conjunction therewith, metal sheets heated to temperatures ranging up to 1000° F can be handled.

A primary disadvantage in the Weiss et al. lifter is described in Column 5, lines 59–64, (U.S. Pat. No. 3,863,969) wherein it is stated that some of the sealing ring binder burns out under exposure to temperatures between 900° and 1000° F. It can thus be inferred that the sealing ring must be replaced from time to time.

Another disadvantage in the Weiss et al lifter is the relatively complex arrangement of metal rings, angular relationships between components, C-washers, and the assembly of spring loaded pressure pins required to force the sealing ring into engagement with the surface of the load to be lifted.

It is an object of my invention to provide a vacuum lifter that is relatively simple and inexpensive to manufacture, which can be used to handle formed metal parts or pieces that are heated to temperatures of 400° F, and higher.

It is another object of my invention to provide a vacuum lifter in which the vacuum seal member is highly resistant to heat and wear.

Other advantages inherent in the vacuum lifter herein disclosed will clearly be seen in the ensuing detailed specification and drawings.

DETAILED DESCRIPTION

Figure 2:
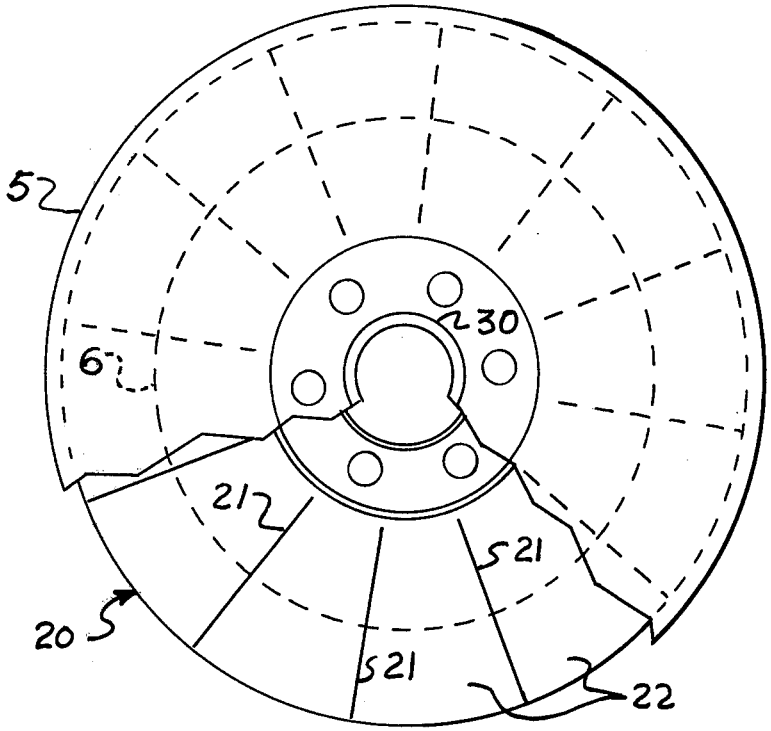
FIG. 2 is a partially cut away plan view of my invention.

The lifting device of my invention preferably takes the form of a shallow frustum or saucer-shaped exterior clamp 5 overlying a complementally shaped plug or interior clamp 6. The underside of the exterior clamp 5 is formed with a tapered wall 7 extending toward its top where a counter core defines a shallow cylindrical socket 8. A flat annular lip 10 extends from the lower edge of the tapered wall 7 to the outer rim of the clamp 5.

The interior clamp 6, which is complementally shaped and dimensioned to fit snugly within the tapered interior of the exterior clamp 5 is formed at its top with a cylindrical pad 13 which is dimensioned to fit with a minimum of clearance into the cylindrical socket 8 of the exterior clamp 5 to maintain the clamps 5 and 6 in relatively tight alignment. The underside of the interior clamp 6 is formed with a flat annular lip 14, similar to the exterior clamp 5, and a concentric shallow tapered wall 15 inwardly of the lip 14 to provide a vacuum chamber 16.

Figure 1:
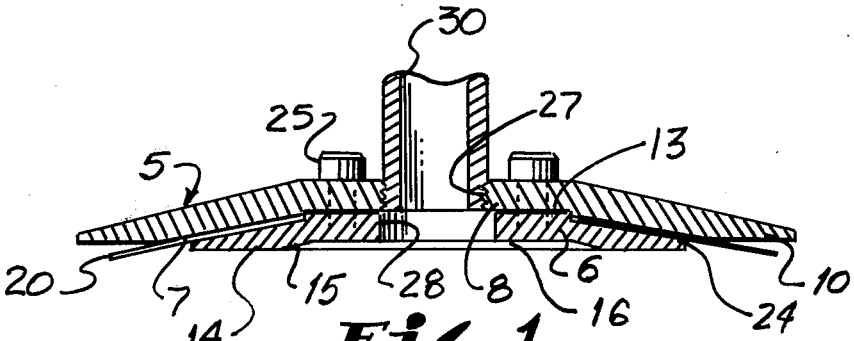
FIG. 1 is a side elevational view, in cross-section, showing a preferred construction of the improved vacuum lifter of my invention.

A segmented sealing ring 20 is the shape of a collar or washer, fabricated of thin, resilient or springy metal such as Rene No. 41, Hastalloy, or Inconel, 0.002 gage for example, is firmly secured between clamps 5 and 6, substantially as shown in FIG. 1. Rene metal, Hastalloy, and Inconel are all readily available in sheet form from most metal suppliers, and are well known materials. The sealing ring 20 is segmented by cutting a number of radially extending slots 21 in any convenient manner, from the outer edge of the ring 20 to within a short distance of the inner edge thereof, thereby defining interconnected springy tabs or leaves 22 extending around the outer edge of the ring 20 as shown in FIG. 2. While I show twelve such leaves 22, a greater or lesser number may suffice for the purpose to be described.

As shown, the tapered wall 7 on the underside of the exterior clamp 5, and the complementally tapered interior clamp 6 define between them angularly disposed clamping surfaces that warp the sealing ring 20 downwardly so that it will engage the surface of a part to be lifted (not shown) at a shallow angle.

The outside diameter of the sealing ring 20 is made slightly smaller than the outside diameter of the exterior clamp 5, but appreciably larger than the outside diameter of the interior clamp 6, to provide sufficient clearance between the underside of the exterior clamp 5 and the upper side of the interior clamp 6 to permit free movement of the resilient leaves 22 of the sealing ring 20. It is preferred to break the angle between the tapered wall 7 and lip 10 on the underside of the exterior clamp 5 with a relatively slight radius 24 to further facilitate free felxing of the sealing ring leaves 22.

The clamps 5 and 6, and segmented sealing ring 20, are assembled and fastened together in any convenient manner, such as by machine screws 25 in threaded bores spaced around the top of the exterior clamp 5 and extending through the interior clamp 6 substantially as shown in FIG. 1.

Inlet ports 27 and 28 are provided through the centers of the clamps 5 and 6, and by means of a pipe 30 threaded into the inlet port 27 of the exterior clamp 5, connect the vacuum chamber 16 to a source of suction (not shown).

To lift a load, for example a heated part from a furnace or oven (not shown), the lifter is placed on the surface of the part and suction is applied through the pipe 30, creating a vacuum in vacuum chamber 16 which draws the leaves 22 of the sealing ring 20 together in tight substantially hermetic formation surrounding the vacuum chamber thereby adhering the lifter to the surface of the part whereby the part can be lifted and conveyed from one location to another.

Figure 3:
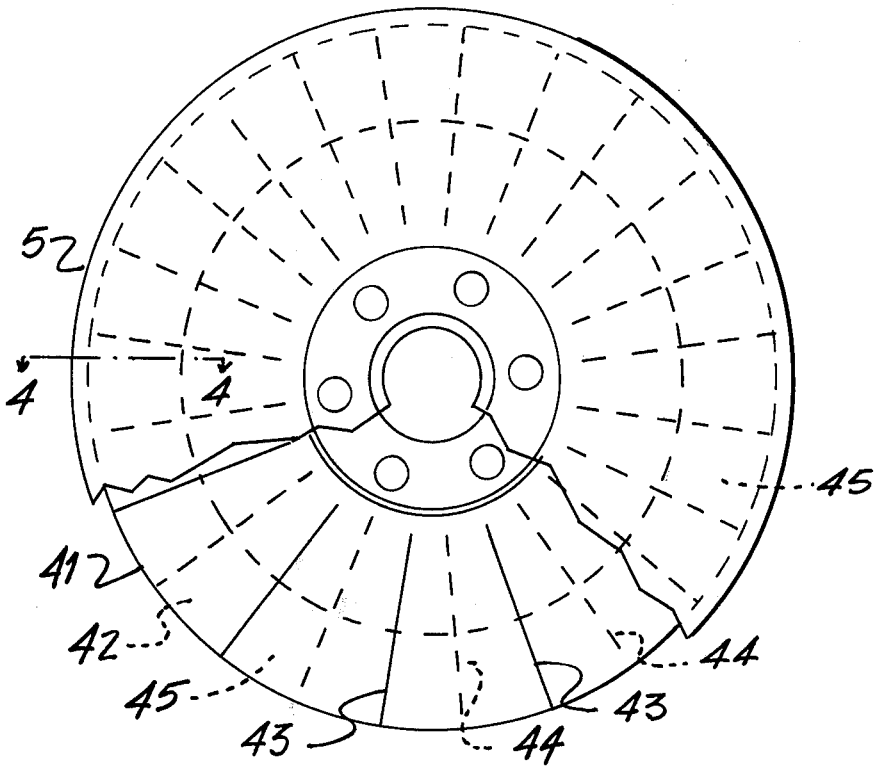
FIG. 3 is a partially cut away plan view of a modified form of my invention.
Figure 4:
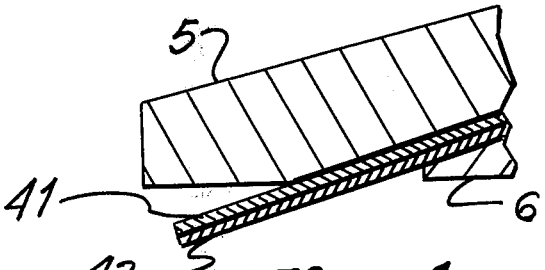
FIG. 4 is a fragmentary cross-sectional view taken on lines 4—4 of FIG. 3.

Although I have found that a lifter constructed as described and illustrated above employing a single segmented sealing ring performs satisfactorily for medium sized parts, it may be preferred for some operations, or use, to employ two segmented rings 41 and 42 as shown in FIGS. 3 and 4, mounting the rings in overlapping relationship but with the slots 43 of one ring 41 staggered with respect to the slots 44 of the other ring 42, i.e., the slots 43 of one ring 41 positioned over the approximate center of the leaves 45 of the other, or vice versa.

A further modification or embodiment of my invention that may occur to those skilled in the art, may take the form wherein individual springy tabs or leaves are arranged and clamped in a ring between clamps. Since the ultimate assembly of such an embodiment necessarily would function in essentially the same manner to perform the same result, I do not deem it necessary to describe and illustrate such embodiment herein, such modification being considered to fall within the scope of the pending claims.

What is claimed is:

1. An improved vacuum lifter comprising:

a. an exterior clamp overlying an interior clamp, b. means defining a vacuum chamber on the underside of said interior clamp within a flat annular lip adapted to engage the surface of an object to be lifted, c. a pair of segmented sealing rings clamped between said exterior and interior clamps, each of said rings being fabricated entirely of thin, high temperature resistent resilient material and radially slotted to define a ring of leaves, said rings being positioned relative to each other with the slots of one ring positioned over the approximate centers of the leaves of the other, said leaves extending beyond and surrounding said vacuum chamber to form a seal, d. and means for applying suction to said vacuum chamber.

2. The improved vacuum lifter according to claim 1 wherein said rings are fabricated to stainless steel.

* * * * *